US006397857B2

(12) United States Patent
Neary

(10) Patent No.: US 6,397,857 B2
(45) Date of Patent: Jun. 4, 2002

(54) HAIR ACCESSARY

(75) Inventor: Lynn Lucia Neary, Cotati, CA (US)

(73) Assignee: Lynn L. Neary, Cotati, CA (US)

( * ) Notice: Subject to any disclaimer, the term of this patent is extended or adjusted under 35 U.S.C. 154(b) by 0 days.

(21) Appl. No.: 09/752,753

(22) Filed: Dec. 29, 2000

Related U.S. Application Data

(60) Provisional application No. 60/173,684, filed on Dec. 29, 1999.

(51) Int. Cl.[7] ..... A45D 8/12; A45D 8/04; A45D 8/00; A45D 24/00

(52) U.S. Cl. ..... 132/275; 132/273; 132/276; 132/200

(58) Field of Search ..... 132/275, 273, 132/276, 278, 212, 200, 207; 2/312, 314, 316, 317, 318, 319; 94/575, 576, 579.1; D28/39, 40, 41

(56) References Cited

U.S. PATENT DOCUMENTS 4,406,296 A * 9/1983 Wexler et al. ..... 132/148
5,097,854 A * 3/1992 Smith ..... 132/275
5,293,884 A * 3/1994 Chapman et al. ..... 132/200
5,577,698 A * 11/1996 Liu et al. ..... 248/214
5,626,503 A * 5/1997 Heftel et al. ..... 446/73
6,032,680 A * 3/2000 Lu et al. ..... 132/275
6,189,543 B1 * 2/2001 Sonstegard ..... 132/275
6,206,011 B1 * 3/2001 Sartena ..... 132/275

* cited by examiner

*Primary Examiner*—John J. Wilson
*Assistant Examiner*—Robyn Kieu Doan

(57) ABSTRACT

In accordance with the invention, a hair accessary is described for a women's hair. The hair accessary includes a includes an elongated rectangularly shaped elastic strap having an inner elongated surface foldable back on itself so as to form a P-shaped hoop in cross section and an outer elongate surface (opposite to the inner surface) to which a series of beaded strings are attached. The P-shaped hoop includes an upright arm and an arcuate arm that intersects the upright arm over a segment of inner elongated surface. As a result, the arcuate arm forms a closed cavity (that incorporates a segment of the inner surface of the strap) so as to enclose a strand of hair of the user yet is flexible to allow radial expansion as required. A portion of the upright arm of the P-shaped hoop is used to support beaded strings. When the strap is folded back upon itself and the P-shaped hoop is formed, disconnectable attachment means positioned on the inner surface provides for disconnectable attachment creates the P-shaped hoop. The shape of the hoop is initially ellipsoidal but stretchable into a more circular shape. A method of use is also described.

11 Claims, 2 Drawing Sheets

HAIR ACCESSARY

This application claims benefit of Ser. No. 60/173,684 for "SNAP-ON HAIR ACCESSARY" filed Dec. 29, 1999

SCOPE OF THE INVENTION

The invention relates to a hair accessory for a women's hair located at the apex of the head including an elongated rectangularly shaped elastic strap having an inner elongated surface foldable back on itself so as to form a P-shaped hoop in cross section and an outer elongate surface (opposite to the inner surface) to which a series of beaded strings are attached. The P-shaped hoop includes an upright arm and an arcuate arm that intersects the upright arm over a segment of inner elongated surface. Note that the arcuate arm forms a closed cavity (that incorporates a segment of the inner surface of the strap) that encloses a strand of hair of the user. A portion of the upright arm of the P-shaped hoop is used to support the series of beaded strings. When the P-shaped hoop is formed, disconnectable attachment means positioned on the inner surface disconnectably creates the P-shaped hoop but allow radial expansion to enhance novel hairstyles. The shape of the hoop is initially ellipsoidal but stretchable into a more circular shape.

BACKGROUND OF THE INVENTION

The prior art is replete with various hairband designs but none have the characteristics of the instant invention.

SUMMARY OF THE INVENTION

In accordance with the invention, a hair accessory is described for a women's hair to be positioned say at the apex of the head. The hair accessary includes an elongated rectangularly shaped elastic strap having an inner elongated surface foldable back on itself so as to form a P-shaped hoop in cross section and an outer elongate surface (opposite to the inner surface) to which a series of beaded strings are attached. The P-shaped hoop includes an upright arm and an arcuate arm that intersects the upright arm over a segment of inner elongated surface. As a result, the arcuate arm forms a closed cavity (that incorporates a segment of the inner surface of the strap) so as to enclose a strand of hair of the user yet is flexible to allow radial expansion as required. A portion of the upright arm of the P-shaped hoop is used to support the series of beaded strings. When the strap is folded back upon itself and the P-shaped hoop is formed, disconnectable attachment means positioned on the inner surface provides for disconnectable attachment creates the P-shaped hoop. The shape of the hoop is initially ellipsoidal but stretchable into a more circular shape. A method of use is also described.

DETAILED DESCRIPTION OF EMBODIMENTS

Figure 1:
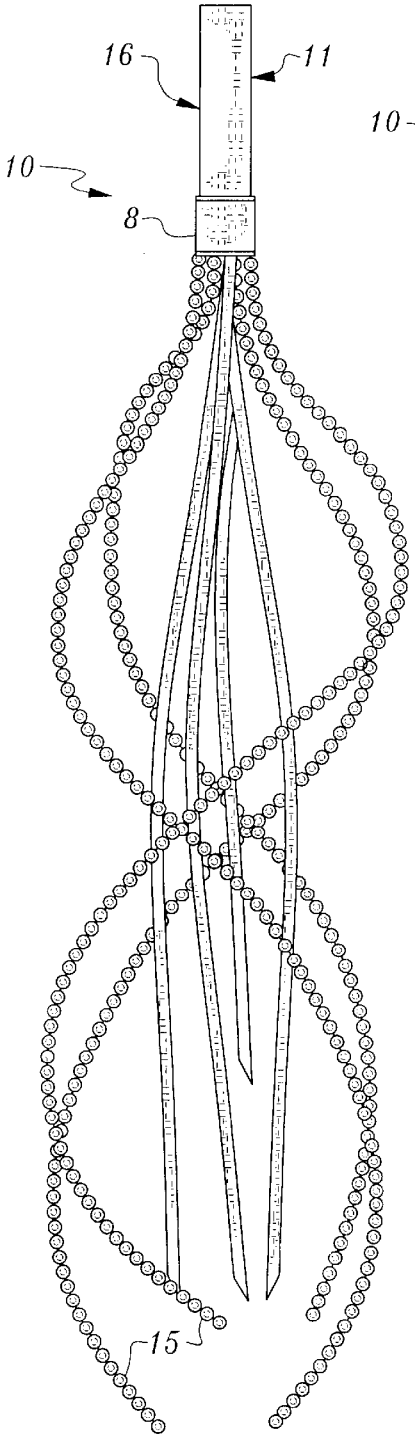
FIG. 1 is a front elevation view of the hair accessory of the invention illustrating how an elastic strap is folded back upon itself.
Figure 2:
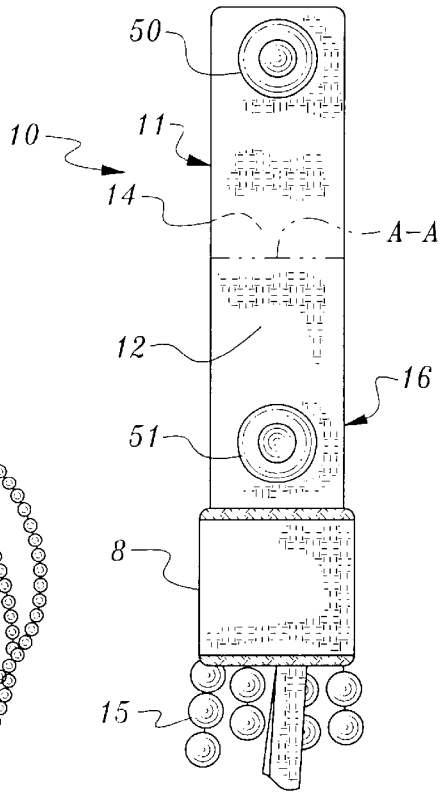
FIG. 2 is a detail of the hair accessory of FIG. 1 illustrating the elastic strap before folding.
Figure 3:
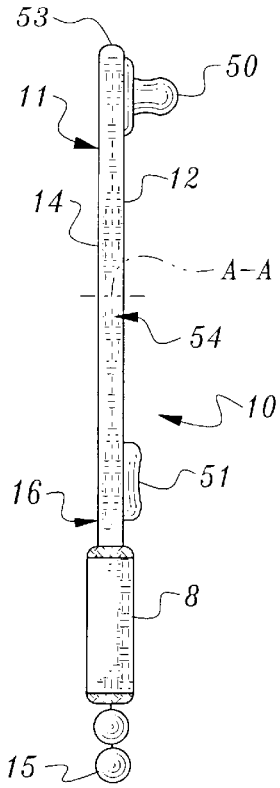
FIG. 3 is a side view of the detail of FIG. 2.
Figure 4:
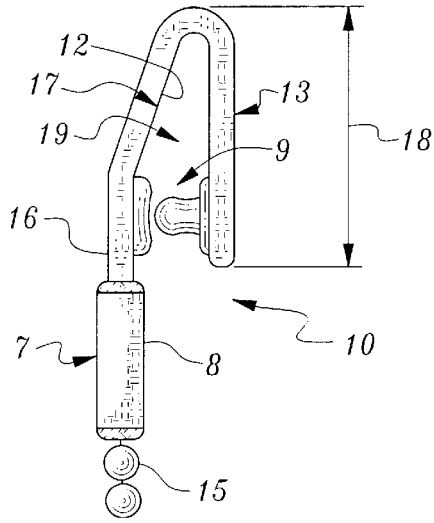
FIG. 4 is a side view of the detail of FIG. 2 after folding has occurred illustrating how a P-shaped hoop is formed.

As shown in FIGS. 1–4, a hair accessary 10 is shown. It includes an elongated rectangularly shaped elastic strap 11 having an inner elongated surface 12 foldable back on itself about axis A—A so that form a P-shaped hoop 13 in cross section. The strap 11 also includes an outer elongate surface 14 (opposite to the inner surface 12) to which a series of beaded strings 15 are attached. The P-shaped hoop 13 includes an upright arm 16 and an arcuate arm 17, the latter intersecting the upright arm 16 over a segment 18 of the inner elongated surface 12. As a result, the arcuate arm 17 forms a closed cavity 19 (that incorporates segment 18 of the inner surface 12 of the strap 11). A portion 7 of the upright arm 16 of the P-shaped hoop 13 is used to support the series of beaded strings 15 after which a cover 8 is sewn to hide such attachment. When the strap 11 is folded back upon itself and the P-shaped hoop 13 is formed, disconnectable attachment means 9 positioned on the positioned on the inner surface 12 of the strap 11 provides for disconnectable attachment and thus aids in the creation of the P-shaped hoop 13. The shape of the arcuate arm 17 is initially ellipsoidal but stretchable into a more circular shape. The disconnectable attachment means 9 comprises a conventional male projecting member 50 and a conventional female receiving member 51, both attached to the inner surface 12 of the strap 11. Note that male projecting member 50 is positioned adjacent to end terminus 53 of the strap 11. While the female receiving member 51 is located near center portion 54 of the strap 11.

Figure 5:
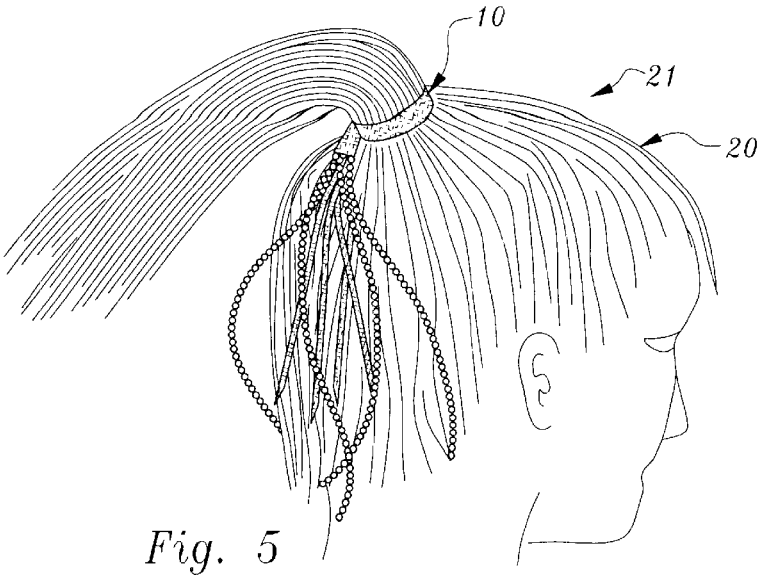
FIG. 5 is a perspective view of the hair accessary akin of FIG. 1 attached to the hair of a women in which strands of hair have been captured within the P-shaped hoop.

FIG. 5 shows usage of the hair accessory 10 of the invention.

As shown, the hair accessary 10 is attached to the apex of the head 20 of a women 21. Note that hair 22 is captured by a conventional rubber band (not shown) with the hair accessory 10 enclosing the latter.

Figure 6:
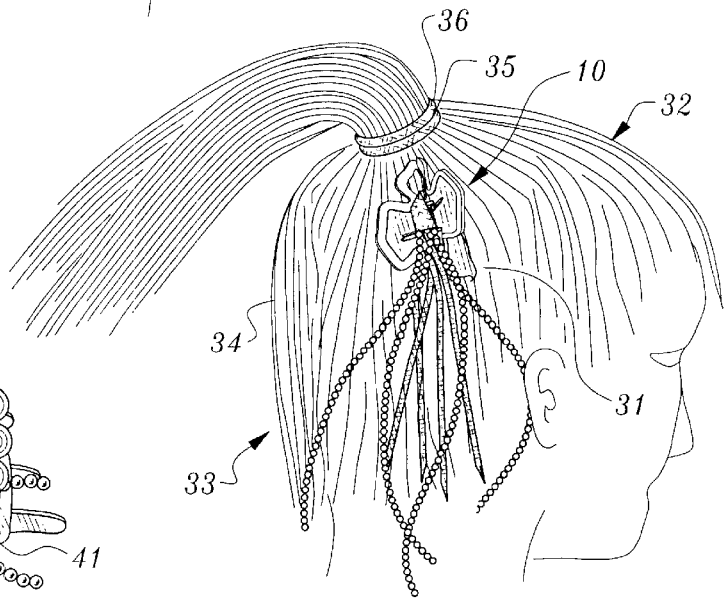
FIG. 6 is yet another perspective view of the hair accessary of FIG. 1 attached to the hair of a women at the side of the head thereof using a conventional clip.
Figure 7:
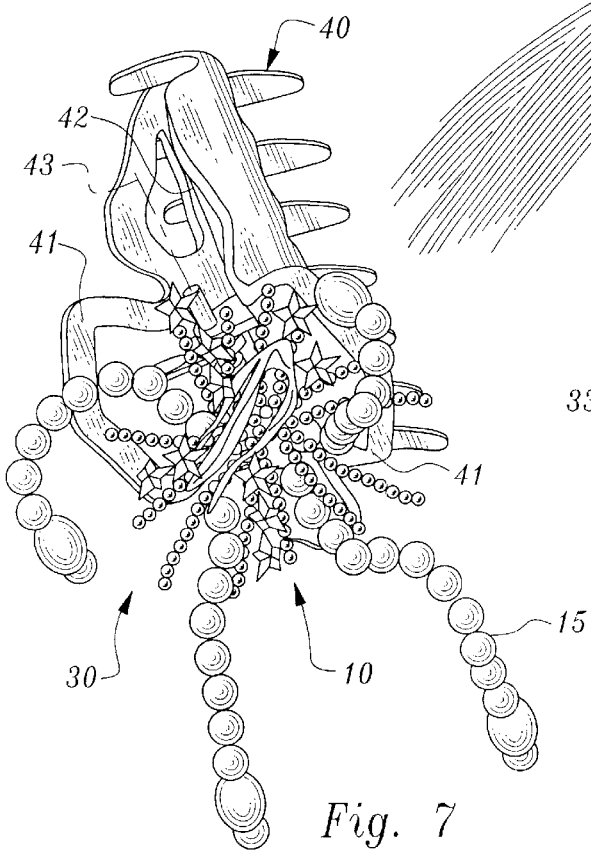
FIG. 7 is a detail perspective of the hair accessary and clip of FIG. 6.

FIGS. 6 and 7 shows other usage of the hair accessary 10 of the invention.

As shown, the hair accessary 10 is captured within a conventional clip 30 wherein the combination is attached to the side 31 of the head 32 of a women 33. Note that hair 34 at the apex 35 of the head 32 is captured by a conventional ponytail holder 36. As shown in FIG. 7, the clip 30 includes a comb 40 and wings 41 rotatable about on axis of rotation 42 of a spring keeper 43 to capture the hair accessary 10.

While the invention has been shown and described with reference to embodiments thereof, it will be understood by those skilled in the art, that various changes, alternatives and variations in form and detail may be made without departing from the spirit and scope of the invention.

For example, the shape of the P-shaped hoop 13 can be changed to provide various arcuate shapes including circular, oblong etc.

Similarly, while the disconnectable attachment means 9 is depicted a conventional snap attachment, other forms are possible including Velco a registered trademark. Their attachment can be sewing or by the use of adhesives, glues and the like.

Also different materials such as pleated scrunchy types can also be used for the cover 8.

What is claimed is:

1. A hair accessory, comprising:

an elongated rectangularly shaped elastic strap having a first end and a second end, said strap further having an inner elongated surface foldable back on itself so as to form a P-shaped hoop in cross-section, and an outer elongated surface opposite to said inner surface, disconnectable attachment means for disconnectably attaching the first end of said elastic strap to the inner surface thereof to create a P-shaped hoop, said P-shaped hoop including an upright arm and an arcuate arm that intersects said upright arm over a segment of said inner elongate surface wherein said arcuate arm forms a closed cavity, and at least one adornment element attached to the second end of said elastic strap.

2. A hair accessory of claim 1 wherein the adornment element is selected from the group consisting of bead strings and ribbons.

3. The hair accessory of claim 1 further comprising a cover over the attachment of the adornment element to said second end of said elastic strap.

4. The hair accessory of claim 3 in which said cover is formed of a ribbon material.

5. The hair accessory of claim 3 in which said cover is formed of a pleated material.

6. The hair accessory of claim 3 in which said disconnectable attachment means includes a conventional male projecting member and a conventional female projecting receiving member forming a snap type connector.

7. The hair accessory of claim 6 in which said male projecting member is positioned adjacent to the first end of said strap 11.

8. The hair accessory of claim 7 in which said female receiving member is located near center portion of said strap.

9. The hair accessory of claim 2 further comprising a comb-like clip attached to said elastic strap and wherein said clip is attachable to the hair of a user.

10. A method for using a hair accessory to enhance the hair of a user, wherein the hair accessory comprises an elongated rectangularly shaped elastic strap having a first end and a second end, said strap further having an inner elongated surface foldable back on itself so as to form a P-shaped hoop in cross-section, and an outer elongated surface opposite to said inner surface, disconnectable attachment means for disconnectably attaching the first end of said elastic strap to the inner surface thereof to create a P-shaped hoop, said P-shaped hoop including an upright arm and an arcuate arm that intersects said upright arm over a segment of said inner elongate surface wherein said arcuate arm forms a closed cavity, and at least one adornment element attached to the second end of said elastic strap, the method comprising the steps of folding the elastic strap of the hair accessory through a device that holds strands of hair, and engaging the attachment means to create a P-shaped hoop through the device that holds the strands of hair.

11. A method for using a hair accessory to enhance the hair of a user, wherein the hair accessory comprises an elongated rectangularly shaped elastic strap having a first end and a second end, said strap further having an inner elongated surface foldable back on itself so as to form a P-shaped hoop in cross-section, and an outer elongated surface opposite to said inner surface, disconnectable attachment means for disconnectably attaching the first end of said elastic strap to the inner surface thereof to create a P-shaped hoop, said P-shaped hoop including an upright arm and an arcuate arm that intersects said upright arm over a segment of said inner elongate surface wherein said arcuate arm forms a closed cavity, and at least one adornment element attached to the second end of said elastic strap, the method comprising the steps of folding the elastic strap of the hair accessory around a device that holds strands of hair; and engaging the attachment means to create a P-shaped hoop around the device that holds the strands of hair.

* * * * *